US006069328A

United States Patent [19]

Oravetz et al.

[11] Patent Number: 6,069,328

[45] Date of Patent: May 30, 2000

[54] CIRCUIT BREAKER MECHANICAL INTERLOCK

[75] Inventors: Tom Oravetz, Springfield; Rodger Alan Tenholder, Strafford, both of Mo.

[73] Assignee: Champion Products, Inc., Strafford, Mo.

[21] Appl. No.: 09/234,886

[22] Filed: Jan. 21, 1999

[51] Int. Cl.[7] ..... H01H 9/26

[52] U.S. Cl. ..... 200/50.33; 200/50.35; 200/43.16

[58] Field of Search ..... 200/43.14, 43.16, 200/43.11, 50.33, 50.35, 50.32

[56] References Cited

U.S. PATENT DOCUMENTS

| | | | |
|---|---|---|---|
| 3,705,280 | 12/1972 | Harms . | |
| 3,801,758 | 4/1974 | Shand et al. . | |
| 4,516,100 | 5/1985 | Wallace et al. . | |
| 4,902,859 | 2/1990 | Witzmann et al. . | |
| 5,393,942 | 2/1995 | Reiner et al. . | |
| 5,725,085 | 3/1998 | Seymour et al. . | |
| 5,977,492 | 11/1999 | Taylor et al. | 200/50.32 |

*Primary Examiner*—Renee S. Luebke
*Attorney, Agent, or Firm*—Lathrop & Gage; Joseph Johnson; William Rudy

[57] ABSTRACT

An apparatus for mechanically limiting a plurality of switch type circuit breakers mounted in linear alignment so that a predetermined number of circuit breaker switches can be in a predetermined position at a time, generally ON, and whereby access to all remaining switches is prevented and the unintentional operation of all remaining switches is prevented. A rigid housing is provided for mounting a plurality of switch-type circuit breakers in linear alignment. An interlock plate is slidably mounted to the housing adjacent the breaker switches. An opening through the interlock plate allows access to the predetermined number of switches which are to be accessible. The solid portion of the cover prevents access to the remaining switches and locking bars on the bottom face of the interlock plate mechanically limit movement of the remaining switches. In order to move the interlock plate to access other breaker switches, all switches must be in the same position, generally OFF. By limiting access to circuit breakers and mechanically preventing actuation of all but a predetermined number of switches and requiring all switches to be in one position before accessing the remaining switches, undesirable and unintended operation of circuit breakers is prevented. Further, the apparatus allows individual circuit breakers to be removed from the housing without removing the interlock plate and jeopardizing the integrity of the device.

15 Claims, 2 Drawing Sheets

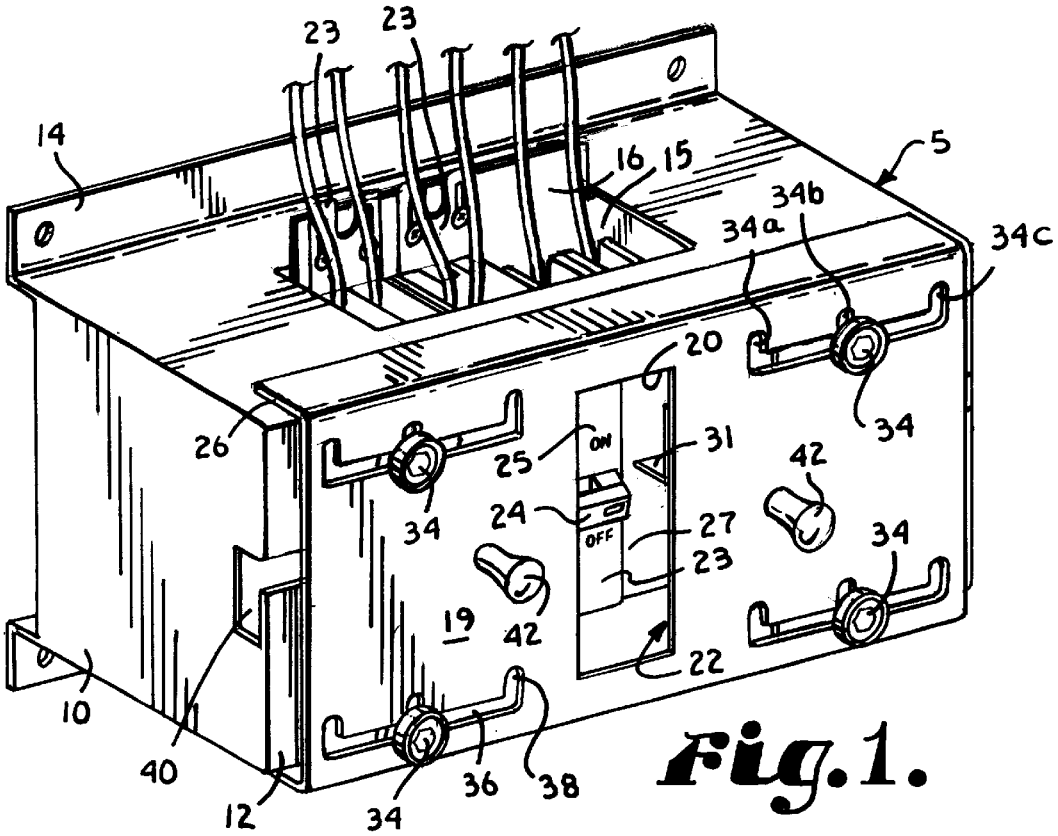
Fig. 1.
Fig. 2.
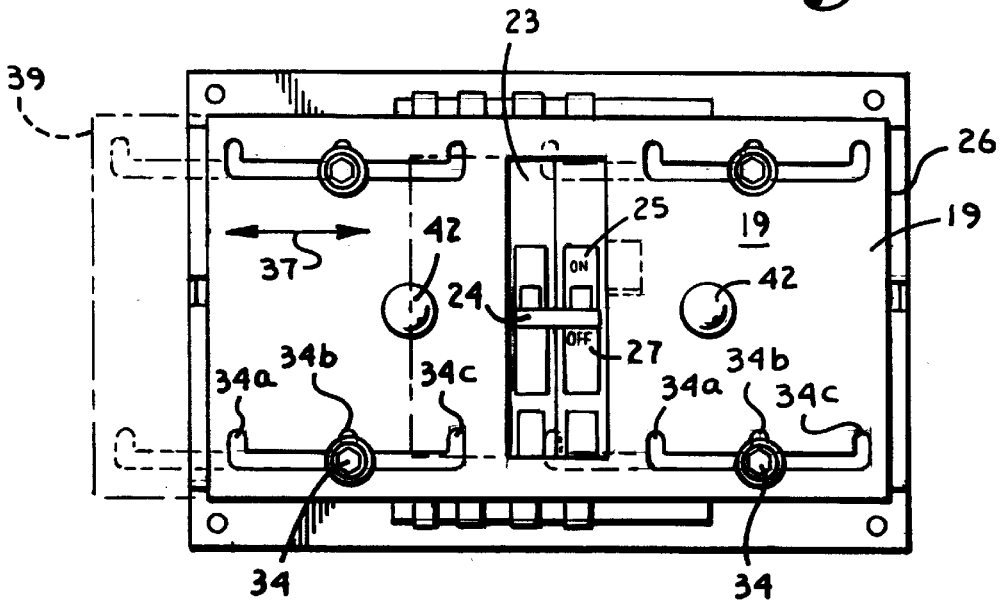

Fig. 3.
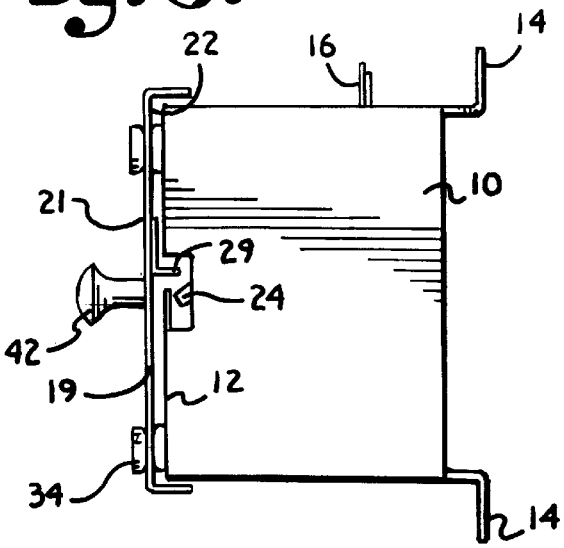
Fig. 4.
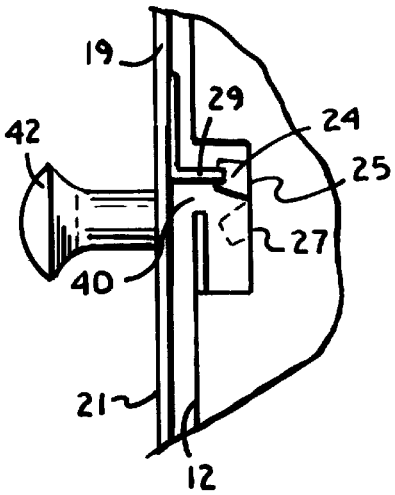
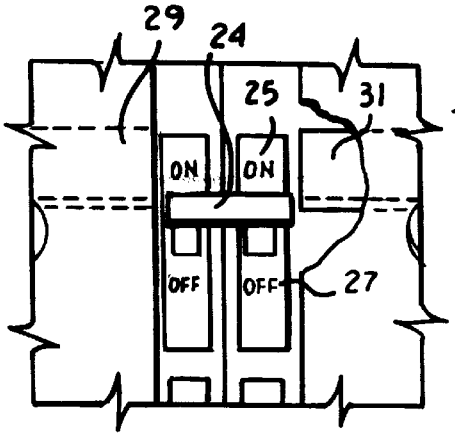
Fig. 5.
Fig. 6.
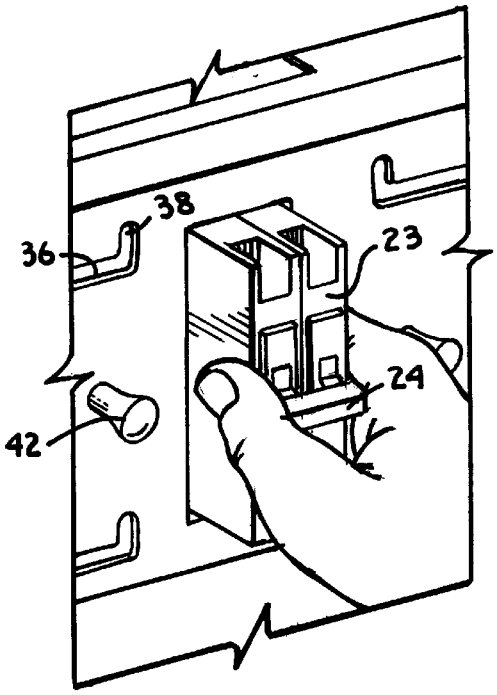

CIRCUIT BREAKER MECHANICAL INTERLOCK

BACKGROUND OF THE INVENTION

1. Field of the Invention

This invention relates to an improved mechanical interlock for multiple switch-type circuit breakers mounted in linear alignment, allowing easy access and replacement of individual circuit breakers, while mechanically limiting the circuit breaker so that only one, or a predetermined number of, breaker switches, can be in a selected position at a time and which cannot be dismantled with ordinary hand tools.

2. Description of the Related Art

It is common to restrict circuit breakers to limit movement, particularly, to prevent unintended operation of one or more of the individual breakers. Limitation of breakers is very desirable in situations where multiple power sources are present to power a limited number of energy consuming devices.

Previously, numerous devices have been utilized to electronically or mechanically limit circuit breakers. Some of these devices are designed to be used with existing circuit breaker boxes commonly found in residential and commercial settings. One such example can be found in U.S. Pat. No. 5,393,942 to Reiner et. al. The Reiner patent discloses an after-market product which is mechanically fixed to existing circuit breakers and provides a padlock hasp for securing the device and limiting tampering or unintentional tripping of the breaker switches. The Reiner device and similar devices have the inherent problem of difficult and unwieldy installation and operation. Moreover, the use of padlocks or other limiting locks, prevents quick and easy manipulation of the breakers when desired and requires only ordinary hand tools to alter the position of the device between circuit breaker switches, or to remove the switches.

Another mechanical interlock device is described in U.S. Pat. No. 3,705,280 to Harms. The device disclosed is particularly suited to a pair of opposed breaker switches so that by switching one breaker ON, the second switch is mechanically forced into the OFF position. The obvious drawback to this device is that it is not readily adaptable to an odd number of switches in a series. Further, it does not allow all switches present to be in the OFF position, which may be desirable for maintenance or repair work on the circuit breaker, the powered device, or structure. Many other devices useful for mechanically limiting pairs of circuit breakers are available and are disclosed in U.S. Pat. No. 4,516,100 to Wallace et al., U.S. Pat. No. 5,725,085 to Seymour et al. and U.S. Pat. No. 4,902,859 to Witzmann et al. However, each of these patents disclose devices which are complex or difficult to operate and maintain.

Other devices useful for limiting the actuation of more than one circuit breaker at a time have been disclosed. One such device is U.S. Pat. No. 3,801,758 to Shand et al. The Shand device uses individual covers mounted over each circuit breaker switch and slidable along a pair of opposed guide rods. One less cover than the number of breaker switches present is provided so that only one breaker switch is exposed and accessible at a time. This device requires installation of multiple parts, including the individual breaker switch covers and the guide rods. A difficulty arises when one or more of the circuit breakers has to be removed in that the guide rods, and the attached covers, have to be removed in order to access the breaker switches. Therefore, during the installation of new switches or the removal of existing switches, it is possible to inadvertently trip adjacent switches. This can result in the overloading of switches, damaged switches or powered devices or systems operatively associated with the circuit breakers.

What is needed is a mechanical interlock device which effectively limits a series of breaker switches so that a predetermined number of adjacent switches will be in the desired ON or OFF position at one time. The instant invention improves upon related devices known within the industry by providing a novel design which easily and effectively mechanically limits the number of circuit breakers in linear alignment so that predetermined number of adjacent switches will be in the desired ON or OFF position at one time. The apparatus disclosed herein is intended to be used when only one switch in a series of switches, in linear alignment, is to be in the ON position at a time. However, the device works equally well in situations where all but one switch is desired to be in the ON position or for any series of switches in linear alignment where it is desired that adjacent switches be operable. For example, in a series of five switches in linear alignment where any two adjacent switches can be in the ON position with the remaining three switches in the OFF position, the apparatus will be configured to allow access and operation to two adjacent switches at a time. Therefore, switches one and two, two and three, three and four, or four and five will be operable with the remaining three mechanically "locked" into the OFF position. Further, the apparatus of the present invention can be reconfigured and utilized without changing the same basic apparatus design for any number of breakers switches in linear alignment and to limit any number of the present breaker switches.

SUMMARY OF THE INVENTION

The stated objects and advantages are satisfied by the present invention which is directed to a rigid housing for a plurality of aligned circuit breaker switches in parallel and an interlock plate, having a switch opening, slidably attached to the housing adjacent to the plurality of circuit breaker switches such that the interlock plate can be moved along the line of switches, providing limited access to only one switch at a time. The interlock plate also has a pair of opposed locking bars on either side of the switch opening, on its bottom face, aligned so that when the one switch accessible through the opening is positioned opposite the remaining switches, the switch is trapped between the locking bars and the interlock plate will no longer slide along the housing. Therefore, when one switch is in the desired position, usually ON, none of the remaining switches are accessible and are maintained in their position, usually OFF, by the locking bars. The housing provided has a switch receptacle for the mounting of the circuit breaker switches and at least one switch access opening adjacent the switch receptacle allows individual switches to be removed from the housing without removing the interlock plate or jeopardizing the safety features of the mechanical interlock.

Thus, it is a principal object and advantage of the invention is to provide an apparatus which houses a predetermined number of dual-position circuit breaker switches in linear alignment and mechanically limits a predetermined number of the switches to be in a desired position at a time.

Another object and advantage of the invention is to provide an apparatus which has one moving part, is easy to operate, and eliminates the possibility of inadvertent actuation of more than the predetermined number of circuit breaker switches at a time.

It is also an object and advantage of the invention to provide a circuit breaker mechanical interlock device which allows individual circuit breakers to be removed from the housing without removing the protective mechanical interlock.

Yet another object and advantage of the invention is to provide a circuit breaker mechanical interlock device which can not be readily tampered with, overridden or circumvented with ordinary hand tools.

Still another object and advantage of the invention is to provide a circuit breaker mechanical interlock device which utilizes one primary moving part, thereby decreasing the wear and tear on the device.

Other objects and advantages of the present invention will become apparent from the following description taken in conjunction with the accompanying drawings, which constitute a part of this specification and wherein are set forth exemplary embodiments of the present invention to illustrate various objects and features thereof.

BRIEF DESCRIPTION OF THE DRAWINGS

FIG. 1 is a perspective view of one embodiment of the innovative apparatus.

FIG. 2 is a front elevation view of one embodiment of the innovative apparatus showing the placement and movement of the interlock cover in one embodiment of the apparatus.

FIG. 3 is a slightly reduced, side elevation view of one embodiment of the innovative apparatus.

FIG. 4 is an enlarged and fragmentary, side elevation view of an interlock mechanism in relationship to a circuit breaker switch in one embodiment of the apparatus.

FIG. 5 is a fragmentary, front elevation view with a cut-away segment showing the relationship of the interlock mechanism to a circuit breaker switch in one embodiment of the apparatus.

FIG. 6 is a partial front elevation view showing the removal of a circuit breaker switch in another embodiment of the apparatus.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 5 generally refers to an apparatus for mechanically interlocking switch type circuit breakers. As shown in FIG. 1, a rigid housing 10 is provided and has a plate face 12, a mounting face 14 and a circuit switch receptacle 16. The plate face 12 has at least one locking stud 34 rigidly but removably mounted thereto. The preferred embodiment of the inventive apparatus 5 generally utilizes four locking studs 34 for added stability, safety and durability. The circuit switch receptacle 16 is configured to receive a plurality of circuit switches 23 of the lever type, with each circuit switch 23 having a manually operable switch lever 24 movable between a plurality of positions, such as an ON position 25 and an OFF position 27, and perhaps a neutral position if desired, for example. The circuit switches 23 are of common type providing a manually selective electrical connection between a power source and a power consuming device or structure.

In the preferred embodiment, each switch lever 24 will be positioned substantially adjacent, but below, the plate face 12. A channel 40 is provided transversely through the plate face 12 with the channel 40 aligned with the switch levers 24 when in the ON position 25, the OFF position 27, other selected position, or a combination thereof if linearly aligned, as herein described.

The plurality of circuit switches 23 are removably mounted to the rigid housing 10 at the circuit switch receptacle 16 and must be mounted in a line so that all of the switch levers 24 are in alignment when in the ON position 25, the OFF position 27, a neutral position, etc. It is to be understood that in some applications, one or more of the circuit switches 23 may be in the ON position 25 as one or more of the circuit switches 23 may be in the OFF position 27, and as one or more of the circuit switches 23 may be in a neutral or other selected position, wherein all of those circuit switches 23 are linearly aligned allowing the interlock plate 19 to be slidably displaced as herein described. As described, an inventive feature of this invention requires that if the circuit switch 23 accessible through a switch opening 20 is thrown to any other position wherein it is not linearly aligned with the other circuit switches 23 that are not accessible through the switch opening 20—be it to the ON position 25, the OFF position 27, or other available position—the slidable displacement of the interlock plate 19 is disabled.

In the preferred embodiment, each of the plurality of circuit switches 23 will be connected to alternate power sources (not shown) intended to generally supply one device or structure. For example, one circuit switch 23 may be attached to a power source or other power supply (not shown), a second circuit switch 23 connected to the same or another power source such as a generator (not shown), and a third circuit switch 23 connected to one of the same or yet another power source such as a battery (not shown). Each power source could power one device or structure under different circumstances and conditions. For an example of the application of the invention described herein, it may be undesirable to have more than one of the switches 23 in the ON position 25 at any time due to potential damage to the wiring, breakers or structure, or the possibility of personal injury.

An interlock plate 19 having a top face 21, a bottom face 22, and the switch opening 20 therethrough, and the interlock plate 19 is slidably mounted to the plate face 12 of the rigid housing 10. At least one locking slot 36 is present through the interlock plate 19 and is operably configured for movable attachment to the locking stud 34 on the plate face 12. The locking slot 36 allows the interlock plate 19 to slide transversely along the face plate 12 of the rigid housing 10 as indicated by the double-headed arrow designated by the numeral 37 in FIG. 2, whereby the interlock plate 19 may be slidingly displaced to the left as suggested by the phantom line designated by the numeral 39, or to the right (not shown for purposes of clarity). The locking slot 36 may have a plurality of securing notches 38. The locking stud 34 will engage a securing notch 38 in the locking slot 36 requiring the interlock plate 19 to be manipulated perpendicular to the longitudinal axis of the rigid housing 10 prior to moving the interlock plate 19 transversely along the plate face 12 within the limitations presented by the locking slot 36. In the preferred embodiment, four locking slots 36 are provided to receive the four locking studs 34. One securing notch 38 should be provided for each of the plurality of circuit switches 23 with the position of each securing notch 38 in locking slot 36 operably positioned such that when interlock plate 19 is moved transversely along the plate face 12 the locking stud 34 engages a first securing notch 34*a*, then a second securing notch 34(*b*) then a third securing notch 34(*c*) and so forth. As the interlock plate 19 is moved allowing engagement of the locking stud 34 with each successive securing notch 38, each successive switch lever 24 becomes accessible through the switch opening 20.

The switch opening 20 will be of predetermined size and configuration to allow access to a predetermined number of switch levers 24. In the preferred embodiment, only one of said plurality of circuit switches 23 will be accessible at a time. The switch opening 20 will allow the operator to move the switch lever 24 between two positions thereof, such as between the ON position 25 and the OFF position 27, but will not allow the operator to access the remaining switch levers 24 of the plurality of circuit switches 23.

Fixed on a bottom face 22 of the interlock plate 19 will be a first locking bar 29 and a second locking bar 31 on opposing sides of the switch opening 20. The first locking bar 29 and the second locking bar 31 are rigid and will extend from an outer edge 26 of the bottom face 22 to the switch opening 20 and extend downward from the bottom face 22 into the channel 40 through the plate face 12 of the rigid housing 10, and substantially adjacent the switch levers 24. When the interlock plate 19 is secured to the plate face 12, the first locking bar 29 and the second locking bar 31 are slidably received within the channel 40 through the plate face. The first locking bar 29 and the second locking bar 31 extend downward into the channel 40 far enough to engage the switch levers 24 when in one of the available positions, such as the ON position 25, the OFF position 27, a neutral position, etc., as herein described. In the preferred embodiment, the first locking bar 29 and the second locking bar 31 will prevent the adjacent switch levers 24 from being re-positioned from their present linearly aligned positions.

The switch lever 24 accessible through the switch opening 20 is not blocked by the first locking bar 29 or the second locking bar 31 from being moved between the ON position 25 and the OFF position 27, for example. However, when the accessible switch lever 24 is in the ON position 25, for example, the interlock plate 19 is mechanically prevented from moving transversely along the plate face 12 of the rigid housing 10 as the switch lever 24 is trapped between the first locking bar 29 and the second locking bar 31. In order to move the interlock plate 19 along the plate face 12 to access the remaining switch levers 24, it is necessary that all the switch levers 24 are in the OFF position 27, for example. Therefore, the innovative apparatus 5 offers dual safety in that the interlock plate 19 physically blocks all but one switch lever 24 and only one switch lever 24 at a time can be in the ON position 25, for example.

The rigid housing 10 has at least one access opening 15 at the circuit switch receptacle 16 whereby the plurality of circuit switches 23 are accessible for repair. However, as described, the position of the first locking bar 29 and the second locking bar 31 prevent movement of switch lever 24 except for the circuit switch 23 accessible through the switch opening 20. Access opening 15 is provided in the rigid housing 10 adjacent the ON position 25 of the switch lever 24 such that only the circuit switch 23 accessible through the switch opening 20 will be removable from the rigid housing 10 without removal of the interlock plate 19 as the switch lever 24 of the non-exposed circuit switches 23 will be trapped by the first locking bar 29 or the second locking bar 31. Knob 42 is provided to assist the operator in moving interlock plate 19.

As shown in FIG. 2, transverse movement of interlock plate 19 is limited by the length of the locking slot 36. As indicated, in the preferred embodiment, four locking slots 36 will be provided to receive the four locking studs 34. One securing notch 38 should be provided for each of the plurality of circuit switches 23 with the position of each securing notch 38 in locking slot 36 operably positioned such that when interlock plate 19 is moved transversely along the plate face 12, the locking stud 34 engages a first securing notch 34(*a*), then a second securing notch 34(*b*), then a third securing notch 34(*c*) and so forth. As the interlock plate 19 is moved allowing engagement of the locking stud 34 with each successive securing notch 38, each successive switch lever 24 becomes accessible through the switch opening 20.

FIG. 3 provides a side view of the innovative apparatus. Switch lever 24 is shown in the OFF position 27 where it is prevented from being manually moved into the ON position 25 by a respective one of the first locking bar 29 or the second locking bar 31. Further, the interlock plate 19, as clearly shown in FIG. 2, prevents access to any of the plurality of circuit switches 23 which are not viewable in the switch opening 20. The mounting face 14 provides a surface to mount the device 5.

FIG. 4 shows in detail that when switch lever 24 is in the ON position 25, that engagement of switch lever 24 by the first locking bar 29 will prevent interlock plate 19 from being moved along the plate face 12. When switch lever 24 is in the OFF position 27, first locking bar 29 lies unrestricted within channel 40 thereby allowing interlock plate 19 to be moved along the plate face 12. Therefore, each switch lever 24 provided must be in the OFF position 27 for the interlock plate 19 to be moved to access the next desired switch lever 24.

As shown in FIG. 5, the first locking bar 29 and the second locking bar 31 are positioned to engage switch lever 24 when in the ON position 25 which prevents lateral movement of interlock plate 19.

An advantage of the inventive apparatus is the ability to remove and replace individual circuit breaker switches 23 through an access opening 15 without removing interlock plate 19 as described above and as shown in FIG. 1. In a modified embodiment of the inventive device, individual circuit breaker switches 23 can be removed through switch opening 20 as shown in FIG. 6. The access opening 20 will be of predetermined size and configuration for easy removal of a circuit switch 23 used in a given application.

Whereas the present invention has been described in relation to the drawings attached hereto, it should be understood that other and further modifications, apart from those shown or suggested herein, may be made within the spirit and scope of this invention.

What is claimed and desired to be covered by Letters Patent is as follows:

1. A circuit breaker mechanical interlock apparatus comprising:

(a) a rigid housing having a plate face and a circuit switch receptacle;

(b) a plurality of circuit switches with each circuit switch having a manually operable switch lever movable between two positions;

(c) an interlock plate having a top face, a bottom face and a switch opening therethrough, said interlock plate slidably mounted to said plate face; and (d) a first locking bar and a second locking bar fixed to said bottom face on opposing sides of said switch opening; and wherein said plurality of circuit switches are removably mounted in parallel to said circuit switch receptacle such that each of said switch levers is in linear alignment and substantially adjacent said plate face and said bottom face, and wherein said first locking bar and said second locking bar are configured to operatively mechanically limit the manual operation of each said circuit switch except those accessible through said switch opening.

2. A circuit breaker mechanical interlock apparatus, comprising:

(a) a rigid housing having a plate face, a mounting face and a circuit switch receptacle, said plate face having at least one locking stud;

(b) a plurality of circuit switches with each circuit switch having a manually operable switch lever movable between a plurality of positions;

(c) an interlock plate having a top face, a bottom face, and a switch opening of predetermined size therethrough, said interlock plate having at least one locking slot for receipt of said at least one locking stud whereby said interlock plate is slidably mounted to said plate face;

(d) a first locking bar and a second locking bar fixed to said bottom face on opposing sides of said switch opening; and wherein said plurality of circuit switches are removably mounted in parallel to said circuit switch receptacle such that each of said switch levers is in linear alignment and substantially adjacent said plate face and said bottom face, wherein said first locking bar and said second locking bar are configured to mechanically limit the manual operation of all of said plurality of circuit switches except those accessible through said switch opening, and wherein at least one of the switch levers is configured such that the placement thereof, accessible through said switch opening in one of said plurality of positions, prevents transverse movement of the interlock plate.

3. The circuit breaker mechanical interlock apparatus of claim 2, wherein said housing has at least one access opening, substantially adjacent said circuit switch receptacle, configured to allow removal of at least one of said plurality of circuit switches without removing said interlock plate.

4. The circuit breaker mechanical interlock apparatus of claim 2, wherein said switch opening is configured to allow access and operation of one of said circuit switches of said plurality of circuit switches.

5. The circuit breaker mechanical interlock apparatus of claim 2, wherein said at least one locking slot is operably configured with a plurality of securing notches equaling in number the number of said plurality of circuit switches so that, as said interlock plate is moved transversely along said plate face of said housing, the engagement of said locking stud in each successive said securing notch allows access to each successive said circuit switch through said switch opening in said interlock plate.

6. The circuit breaker mechanical interlock apparatus of claim 2 wherein said first locking bar and said second locking bar are configured to mechanically prevent movement of said interlock plate when any one of said plurality of circuit switches is positioned opposite the remaining said plurality of circuit switches.

7. A circuit breaker mechanical interlock apparatus, comprising:

(a) a rigid housing having a plate face, a mounting face and a circuit switch receptacle, said plate face having at least one locking stud and a channel transversely therethrough;

(b) a plurality of circuit switches with each circuit switch having a manually operable switch lever movable between an ON position and an OFF position;

(c) an interlock plate having a top face, a bottom face, and a switch opening therethrough, said switch opening of predetermined size and configuration to allow access to only one of said plurality of circuit switches, said interlock plate having at least one locking slot for receipt of said at least one locking stud such that said interlock plate is slidably mounted to said plate face; and (d) a first locking bar and a second locking bar fixed to said bottom face on opposing sides of said switch opening; and wherein said plurality of circuit switches are removably mounted in series to said circuit switch receptacle such that each of said switch levers is in linear alignment and substantially adjacent said plate face and said bottom face, wherein said first locking bar and said second locking bar is configured to extend downward into said channel in said face plate to mechanically limit the manual operation of all of said plurality of circuit switches except those accessible through said switch opening, wherein said first locking bar and said locking bar are configured such that all of said plurality of circuit switches must be in the OFF position for the interlock plate to be moved transversely along the plate face, and wherein the positioning of any one of said plurality of circuit switches accessible through said switch opening in the ON position is configured to prevent movement of the interlock plate transversely along the plate face.

8. The circuit breaker mechanical interlock apparatus of claim 7, wherein said housing has at least one access opening substantially adjacent said circuit switch receptacle, said at least one opening configured to allow removal of any number of said plurality of circuit switches without removing said interlock plate.

9. The circuit breaker mechanical interlock apparatus of claim 8, wherein said access opening is operably configured for the removal of only one of the plurality of circuit switches.

10. The circuit breaker mechanical interlock apparatus of claim 7, wherein said switch opening is configured to allow access to and operation of one of said circuit switches of said plurality of circuit switches.

11. The circuit breaker mechanical interlock apparatus of claim 7, wherein said at least one locking slot is operably configured with a plurality of securing notches equaling in number the number of said plurality of circuit switches such that, as said interlock plate is moved transversely along said plate face of said housing, the engagement of said locking stud in each successive said securing notch allows access to each successive said circuit switch through said switch opening in said interlock plate.

12. The circuit breaker mechanical interlock apparatus of claim 7, wherein said first locking bar and said second locking bar are configured to mechanically prevent movement of said interlock plate when any one of said plurality of circuit switches is positioned opposite the remaining said plurality of circuit switches.

13. The circuit breaker mechanical interlock apparatus of claim 7, further comprising at least one knob fixed to said interlock plate.

14. The circuit breaker mechanical interlock apparatus of claim 7, wherein said switch opening is operably configured for the removal of the plurality of circuit switches.

15. The circuit breaker mechanical interlock apparatus of claim 7, wherein said switch opening is operably configured for the removal of only one of the plurality of circuit switches.

* * * * *